United States Patent [19]

Tice

[11] Patent Number: 4,979,934

[45] Date of Patent: Dec. 25, 1990

[54] CARD FEEDING AND FOLDING APPARATUS

[76] Inventor: William A. Tice, 7005 Monarch Ct., Knoxville, Tenn. 37918

[21] Appl. No.: 355,059

[22] Filed: May 18, 1989

Related U.S. Application Data

[60] Continuation of Ser. No. 36,492, Apr. 9, 1987, abandoned, which is a division of Ser. No. 888,783, Jul. 22, 1986, Pat. No. 4,677,923.

[51] Int. Cl.[5] ..... D05B 3/12; B31B 1/68

[52] U.S. Cl. ..... 493/446; 493/380; 493/383; 493/384; 112/104; 112/121.27

[58] Field of Search ..... 493/178, 211-216, 493/221, 226, 379, 375, 376, 374, 383, 380, 384, 446, 447; 112/104, 121.27

[56] References Cited

U.S. PATENT DOCUMENTS

| | | | |
|---|---|---|---|
| 890,464 | 6/1908 | Staude | 493/437 |
| 2,750,186 | 6/1956 | Broneau et al. | 493/937 |
| 3,490,198 | 1/1970 | Beckman et al. | 493/437 |
| 3,812,800 | 5/1974 | Ziegler | 112/104 |
| 4,287,842 | 9/1981 | Breck, Jr. | 112/104 |

*Primary Examiner*—Frederick R. Schmidt
*Assistant Examiner*—Jack W. Lavinder
*Attorney, Agent, or Firm*—Luedeka, Hodges & Neely

[57] ABSTRACT

An apparatus for feeding and folding cards from a card supply to a work surface at which the cards are utilized in a folded configuration in a work cycle. The cards are delivered to the work surface by a delivery mechanism and a folding device folds the cards as they are delivered to the work surface so that the cards are in the folded configuration when they arrive for utilization in the work cycle. Structure is provided for holding the cards in the folded configuration at the work surface.

11 Claims, 7 Drawing Sheets

CARD FEEDING AND FOLDING APPARATUS

This application is a continuation of application Ser. No. 07/036,492, filed Apr. 9, 1987, which is a division of application Ser. No. 06/888,783, filed July 22, 1986, now U.S. Pat. No. 4,677,923, issued July 7, 1987.

The present invention relates to card feeding methods and apparatus, and more specifically relates to an apparatus and method for feeding cards, tags, and the like to a predetermined position above a sewing surface.

Card feeding apparatus are used in the textile industry to feed cards to a sewing station where they are sewn to clothing and other fabric items. In one type of known card feeder, the card is fed to a work table and held in proper position by suction applied through holes in the work table. Other card feeders deliver the cards to an attachment device on the presser foot of a sewing machine. One problem with these designs is that the positioning of the card is limited by the sewing machine. That is, the card must be positioned either on the presser foot or on the work table. The present invention provides a separate gripper for holding the card above the work table. Since the gripper is separate from the sewing machine, the card is positioned independently of the sewing machine.

In some card feeders, the mechanism that feeds the card to the sewing station also holds the card at the sewing operation. Since the gripper of the present invention is independent of the delivery mechanism that actually feeds the card to the sewing station, delivery of the next card may begin immediately after the preceding card is delivered to the gripper. It is not necessary for the delivery mechanism to remain at the sewing station and wait on the sewing operation.

The card feeder of the present invention also folds the card and holds the folded card at the sewing station in proper position for being sewn. Although folding mechanisms are well known in a variety of arts, card feeders for sewing machines generally do not fold cards and do not provide structure for holding folded cards at a sewing station in a useful position. As used above, the term "fold" is used in a broad sense and includes, for example, the concept of bending the card without substantially creasing it or with only minor creasing so that the resiliency of the card urges it to unfold. Unlike the present invention, known card feeders do not fold a card to a resilient folded configuration and hold such resilient folded card at a sewing station in a useful position. In one sense, a resilient folded card is cumbersome to handle, but the present invention takes advantage of the cards resiliency to help hold the card in a desired position so that material may be inserted into the folded section of the card.

In accordance with a preferred embodiment of the present invention, an apparatus is disclosed for feeding and folding cards from a card supply to a work surface at which the cards are utilized in a folded configuration in a work cycle. The apparatus includes a delivery mechanism which delivers a card from the card supply to the work surface. Structure is provided for folding the cards so that the card is in the folded configuration at the work surface for utilization in the work cycle, and provision is made for holding the card in the folded configuration at the work surface. Preferably, the structure for folding the card is configured to fold the card as it is delivered from the card supply to the work surface thereby making the card available at the work surface in the folded configuration upon arrival.

In one embodiment, the card is folded using a folding block which is disposed to contact the card as it is delivered to the work surface by the delivery mechanism. The block is configured together with the delivery mechanism to fold the card upon the card making contact with the block so that the card is disposed substantially in the folded configuration upon its arrival at the work surface. Preferably, the delivery mechanism includes apparatus configured to hold a first portion of the card as the card is delivered to the work station with a second portion of the card being disposed to contact the folding block during delivery of the card. The folding block includes a first edge for making initial contact with the second portion of the card to cause the card to be folded along a first fold line extending generally between the first and second portions of the card. The folding block further includes a second edge for making contact with the second portion of the card subsequent to folding of the card along the first line, the second edge being configured to cause the second portion to be folded along a second fold line which is spaced from the first fold line to dispose a first segment of the second portion of the card generally parallel to the first portion of the card with a second segment of the second portion extending generally between the first and second fold lines.

These and other advantages and aspects of the invention will be readily appreciated by those of ordinary skill in the art as the same becomes better understood by reference to the following detailed description when considered in conjunction with the accompanying drawings in which.

Figure 1:
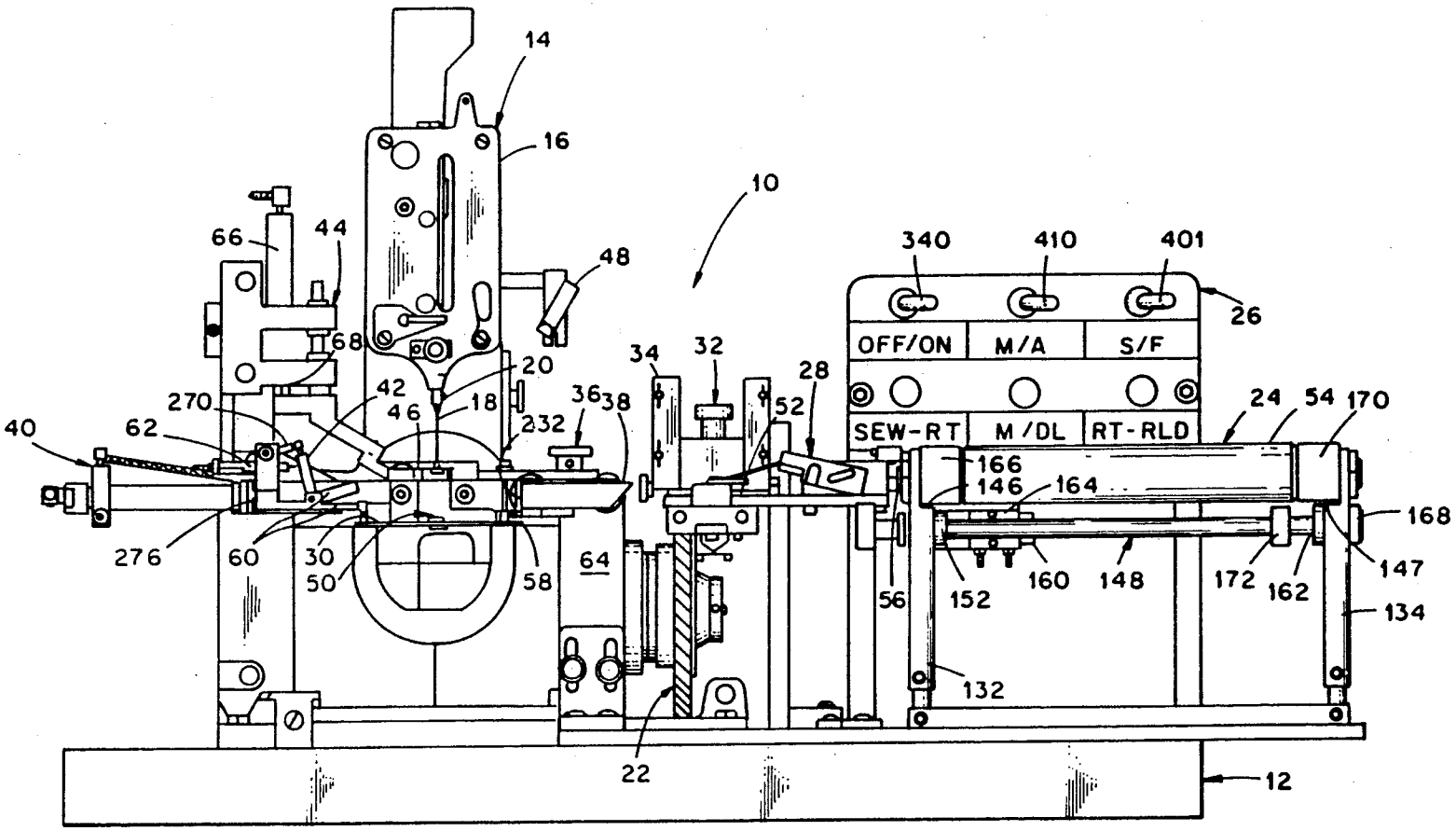
FIG. 1 is a front elevational view of a preferred form of a card feeding apparatus according to the present invention.
Figure 6:
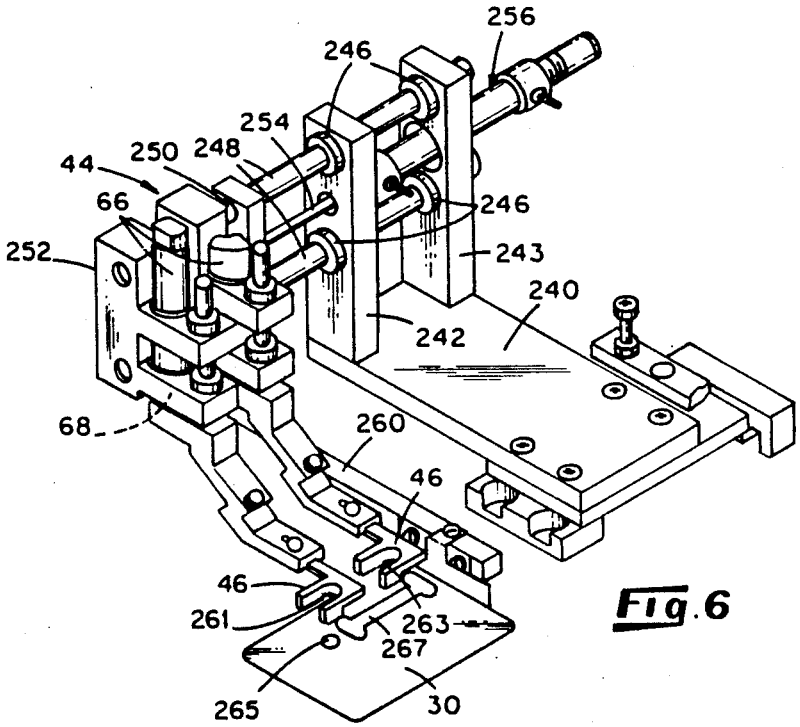
Figure 7:
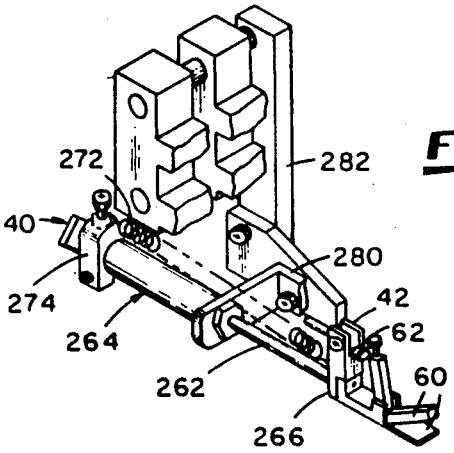
Figure 8:
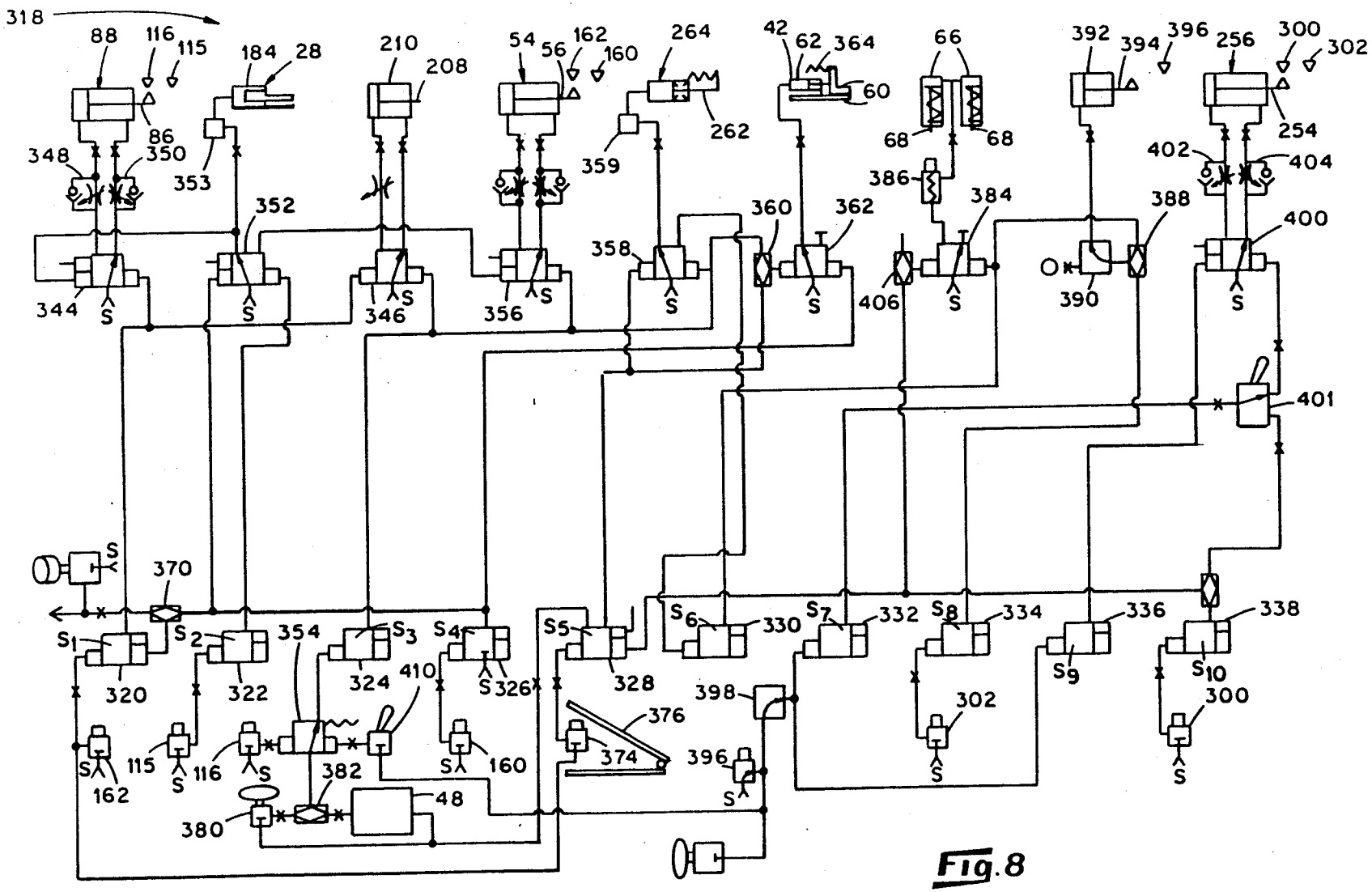

FIGS. 5*a* through 5*e* illustrate stepwise, simultaneous advancement of a folding block of the card folding assembly and a feed plate of the card delivery assembly generally perpendicularly relative to each other to fold a card;

FIG. 6 is a perspective view of a presser foot and throat plate assembly of the apparatus of FIG. 1;

FIG. 7 is a perspective view of a gripping and holding assembly of the apparatus of FIG. 1; and FIG. 8 is a diagrammatical illustration of a pneumatic system for controlling the sequence of operations of the various components of the card feeding apparatus.

Figure 2:
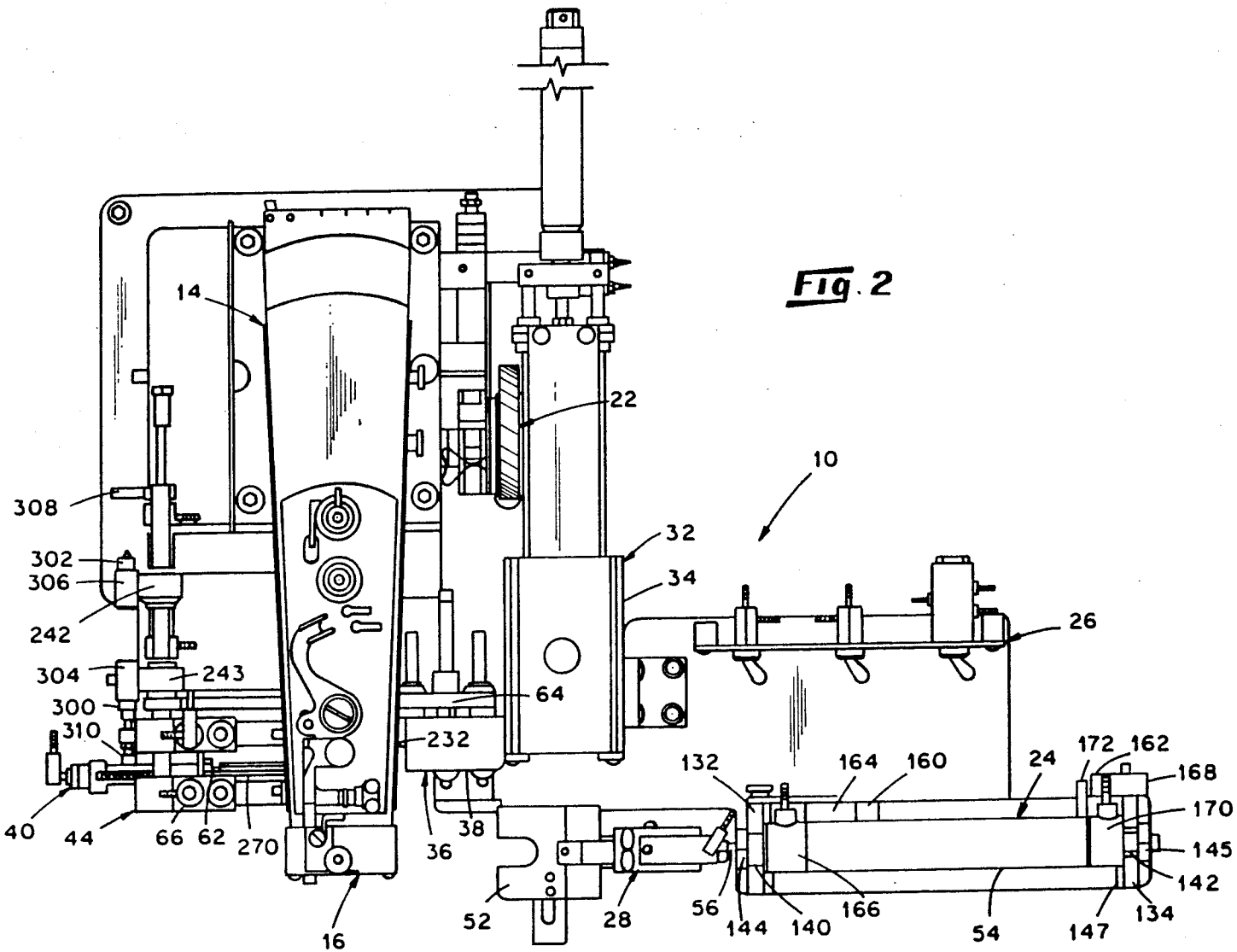
FIG. 2 is a top view of the card feeding apparatus of FIG. 1.

Referring now to the drawings in which like reference characters refer to like or similar parts throughout the several views, there are shown in FIGS. 1 and 2 front and top views, respectively, of a card feeding apparatus 10 illustrating a preferred embodiment of the present invention. A work table 12 supports a cycle sewing machine 14 of a conventional type having a sewing head 16 and a needle 18 supported by a needle bar 19 for being vertically reciprocated by internal mechanisms of the sewing machine 14 in a conventional manner. A belt drive 22 is mounted on the right side of the sewing machine 14 as viewed in FIG. 1 and a clutch mechanism (not shown) interposed between the belt drive 22 and the sewing machine 14 is selectively actuated, preferably by means of a foot pedal (not shown) mounted beneath the work table 12, to translate the energy provided by the belt drive 22 to the sewing machine 14.

A delivery assembly 24 is shown mounted above the work table 12 to the right of the sewing machine 14 in front of a control/display panel 26. A card holder 28 of the delivery assembly 24 is reciprocatably supported thereon for being advanced and retracted towards and away from, respectively, a throat plate 30 of the sewing machine 14, which is the sewing surface on which articles are positioned, and above which the cards are delivered by the delivery assembly 24. A card loading assembly 32 is mounted above the work table 12 generally intermediate the d®livery assembly 24 and the sewing machine 14 for loading cards onto the card holder 28, and is located behind the card holder 28 as viewed in FIG. 1 when the card holder 28 is retracted. A card magazine 34 of the card loading assembly 32 contains a supply of cards for being individually loaded onto the holder 28 in a manner to be described.

A card folding assembly 36 is mounted above the work table 12 generally intermediate the throat plate 30 and the card magazine 34, and has a folding block 38 for being urged crosswise of the path of movement of the card holder 28 against a card being delivered to a position above the throat plate 30 by the delivery assembly 24 to cause the card to be folded. A gripping assembly 40 is mounted to the left of the sewing machine 14 and has a gripping head 42 for being advanced and retracted towards and away from, respectively, a predetermined position above the throat plate 30 to receive and hold a card delivered to the position above the throat late 30 by the delivery assembly 24.

The throat plate 30 is incorporated into a presser foot assembly 44 mounted adjacent the left-hand side of the sewing machine 14 which includes a pair of presser feet 46 see FIG. 6) for being moved downwardly in the direction of the upper surface of the throat plate 30 to clamp the card and a work piece, such as a material segment, between the presser feet 46 and the work plate 30. The presser foot assembly 44 is also mounted for being shifted, while clamping the card and material segment, to selected locations beneath the sewing head 16 as the sewing machine 14 conducts a sewing operation according to a predetermined sewing program.

A sensor 48, preferably a photoelectric cell and its associated light source, is mounted on the right-hand side of the sewing head 16 for sensing removal of the card and material segment from beneath the sewing head 16, the general area beneath the sewing head 16 at which a sewing operation is performed being referred to hereinafter as a sewing station 50, and for producing a signal in response to removal of the card and material segment from the sewing station 50 to cause the delivery assembly 24 to deliver a card to the sewing station 50. Thus, the apparatus 10 is responsive to removal of a card from the sewing station 50 to automatically feed another card to the sewing station 50, insuring substantially constant availability of cards for being attached to material segments.

In operation, the card feeding apparatus 10 is operable to deliver a card to a predetermined position above the throat plate 30 and, by virtue of a predetermined sewing program, attach the card to a material segment. In this regard, sewing of a card to a pocket of a pair of pants will be utilized hereinafter as an exemplary operation to illustrate one particularly advantageous use of the card feeding apparatus 10.

The process of delivering a card to the sewing station 50 is considered to be initiated by loading a card onto a feed plate 52 of the card holder 28, the details of which are to be described more fully below. Essentially, the card loading assembly 32 is operable to load a card onto the feed plate 52 only when the card holder 28 is in its retracted position, which would be the case immediately subsequent to delivery of a card to the sewing station 50, or upon the turning on of apparatus 10 at the control panel 26. The card holder 28 is responsive to loading a card from the card magazine 34 onto the feed plate 52 to clamp a card on the feed plate 52.

Preferably, movement of the card holder 28 is accomplished by selectively admitting compressed air from an air compressor (not shown) into a double acting pneumatic cylinder 54 which carries a rod 56 on which the holder 28 is mounted, causing the rod 56 to move out of the air cylinder 54 in the direction of the sewing station 50. As the holder 28 is advancing, the folding block 38 is made to advance crosswise of the direction of movement of the card holder 28 with the card being moved against the surface of the advancing folding block 38 to cause the card to be folded in a manner to be described.

Simultaneously with advancement of the card holder 28, the gripping head 42 is made to advance to a position above the throat plate 30, just to the left of its center, to receive between a pair of vertically opposed jaws 60, the leading edge of the card. A gripclosing, single acting pneumatic cylinder 62 of the gripping assembly 40 is responsive to advancement of the card holder 28 to its position above the throat plate 30 to cause the jaws 60 to converge and hold the card therebetween. At the same time, the card holder 28 releases the card and the rod 56 is moved back into the cylinder 54 to retract the card holder 28 to its position adjacent the card loading assembly 32. Arrival of the card holder 28 at its retracted position causes the folding block 38 to retract in the direction of a folding block support 64 away from the path of movement of the holder 28, preparatory to being again advanced crosswise of the card holder 28 during its advancement. The card loading assembly 32 is also responsive to arrival of the card holder 28 at the retracted position to load a card onto the feed plate 52.

Ordinarily, the next step involves positioning a material segment, such as a pocket, over the upper surface of the throat plate 30 between the throat plate 30 and the now upwardly extended presser feet 46. It is often desired to insert a turned under portion of the folded card into the pocket whereupon a sewing or tacking operation will be performed to attach the card to the pocket. To facilitate this operation, the upper part of the folded card is held at a predetermined position above the throat plate by the jaws 60 of the gripping head 42 (see FIG. 5*e*). As described below, the tuck of the folded card is oriented in the direction of the back of the sewing machine 14, with the lower part of the folded card laying against the upper surface of the throat plate 30. The pocket of the item to which the card is to be attached is then placed over the throat plate 30 with the throat plate 30 and lower portion of the card extending into the recess area of the pocket. Usually, the edge of the pocket is advanced up to the end of the tuck so that the edge of the pocket and the fold line of the card will be in contact. Once the pocket is thusly positioned, a foot pedal or other suitable device (not shown) is activated to energize the sewing machine 14 and cause the latter to begin its predetermined sewing program. When the machine 14 is energized, the presser feet 46 move downwardly towards the throat plate 30 by means of compressed air introduced into a pair of vertical, single acting, spring loaded pneumatic cylinders 66 of the presser foot assembly 44 driving downwardly a pair of rods 68 carried within the cylinders 66, the bottom ends of which support the presser feet 46, by a predetermined distance to clamp the pocket and folded card between the presser feet 46 and the throat plate 30. Also responsive to energizing of the machine 14 are the jaws 60 of gripping head 42 which are made to open to release the card at the same time the presser feet 46 begin moving downwardly. The clip 42 is also retracted away from the sewing station 50 at this time so that the lower of the jaws 60 does not interfere with downward movement of the presser feet 46, and so that the upper of the jaws 60 does not interfere with movement of the throat plate 30 and presser feet 46 to positions under the needle 18.

After the sewing program is completed, removal of the pocket and its attached card from the sewing station 50 causes the sensor 48 to produce a signal to which the delivery assembly 24 responds by delivering another card to the sewing station 50.

Figure 3:
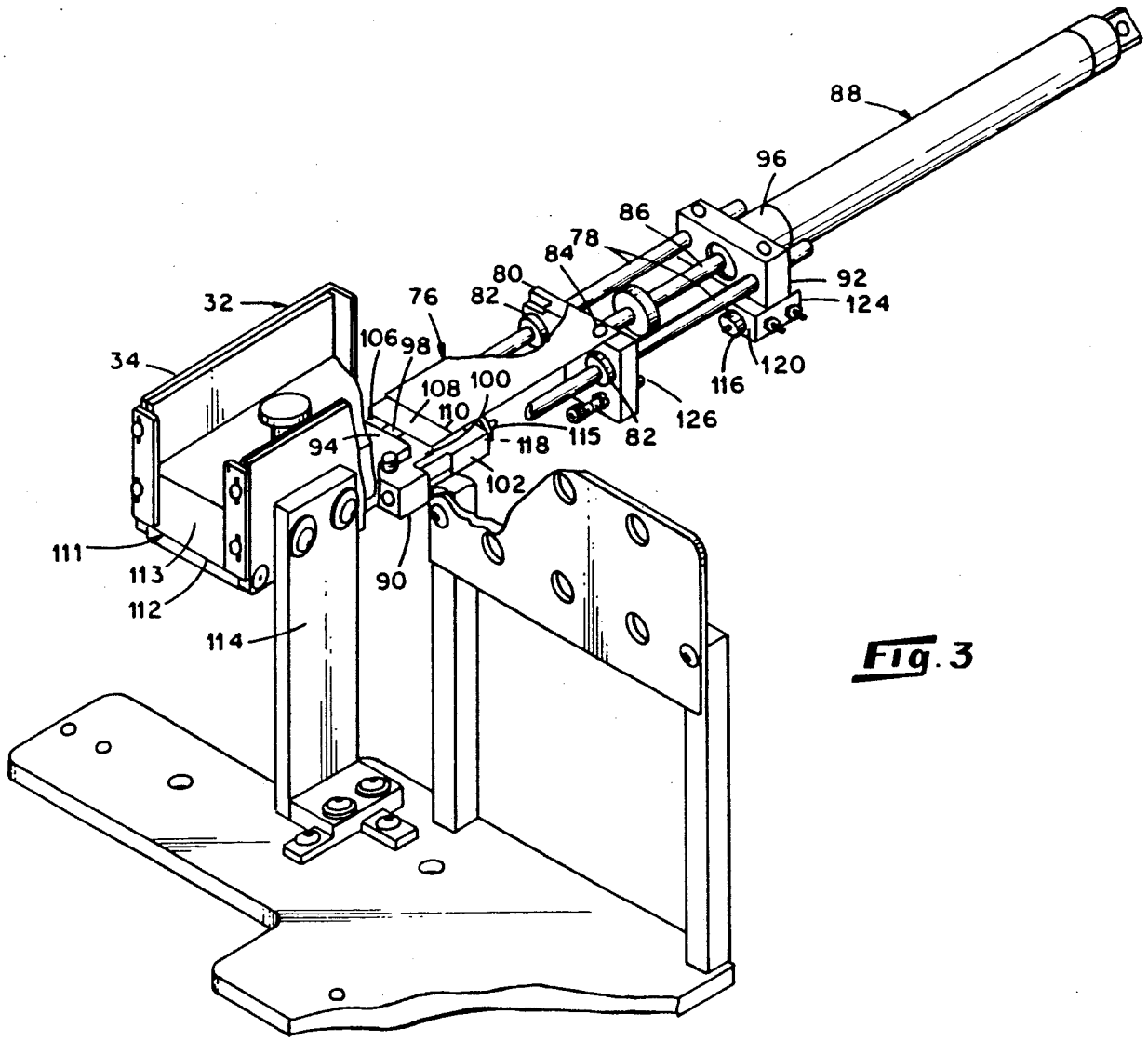
FIG. 3 is a perspective view of a card loading assembly of the apparatus of FIG. 1, some parts being broken away and shown in section.

Referring now to FIG. 3, the card loading assembly 32 is illustrated and includes a pusher member 76 slidably mounted on a pair of spaced-apart guide rods 78 by means of a guide block 80 having spaced-apart sleeves 82 slidable receiving therethrough the guide rods 78. The pusher member 76 is attached to the guide block 80 at the rearward end of the pusher member 76 such as by round-head screws 84 (only one of which is shown) extending through the pusher member 76 into the upper surface of the guide block 80. The guide block 80 is connected to a rod 86 carried within a double acting pneumatic cylinder 88 which is operable to cause the piston 86 to reciprocate by selectively admitting compressed air into the air cylinder 88. The guide rods 78 are supported in a generally parallel relationship between a pair of support blocks 90 and 92 mounted beneath a bed 94 of the card magazine 34, and at a head 96 of the cylinder 88, respectively.

The pusher member 76 is made to travel slidably on an upper surface 98 of a support member 100 mounted atop a stop block 102 extending rearwardly of and below the bed 94 of the card magazine 34. The upper surface 98 of the support member 100 is substantially flush with the upper surface of the bed 94 to insure that movement of the pusher member 76 onto the bed 94 does not cause engagement of a leading edge 104 of the pusher member with a rear edge 106 of the bed 94. When the pusher member 76 is moved onto the bed 94 in the direction of the front of the card magazine 34, a thin, flat tongue portion 108, the front edge of which is defined by the leading edge 104, slides under the bottom card in the magazine 34. Continued movement of the pusher member 76 towards the forward end of the magazine 34 causes a shoulder 110 of the pusher member 76 to engage the back edge of the bottom card in the magazine 34 pushing the card from beneath the stack through a slit 111 between a lower edge 112 of a shutter 113 at the front of the card magazine 34 and the bed 94, and in the direction of the card holder 28 of the delivery assembly 24 onto the feed plate 52. The vertical height of the shoulder 110 is dimensioned t be slightly less than the thickness of the cards so that only one card will be pushed out of the magazine 34 when the pusher member 76 is made to move along the surface of the bed 94.

An L-shaped bracket 114 supports the magazine 34 at a predetermined height above the work table 12 so that a card moving out of the bottom of the magazine 34 will be loaded onto the upper surface of the feed plate 52. Other support structure (not shown) holds the cylinder 88 in a substantially horizontal orientation to permit movement of the pusher member 76 in substantially the same plane as the plane of the bed 94 of the card magazine 34.

A pair of limit valves 115 and 116 are located at a rearward face 118 of the stop block 102 and a front face 120 of a valve block 124, respectively The valve 115 attached to the stop block 102 projects rearwardly of the card magazine 34 to be engaged by the guide block 80 as it is moved towards the card magazine 34. The valve 115 is operable to interrupt the supply of compressed air to the cylinder 88 to stop forward motion of the support block 80, and thus the pusher member 76, and is further operable to cause the card holder 28 to clamp the card on the feed plate 52. Actuation of the valve 115 also causes retraction of the support block 80 rearwardly of the card magazine 34 with the rearward movement of the block 80 being limited by engagement of the end of a rearwardly projecting screw 126 with the valve 116 interrupting the supply of compressed air to the cylinder 88, whereupon the pusher member 76 remains in a retracted position.

Figure 4:
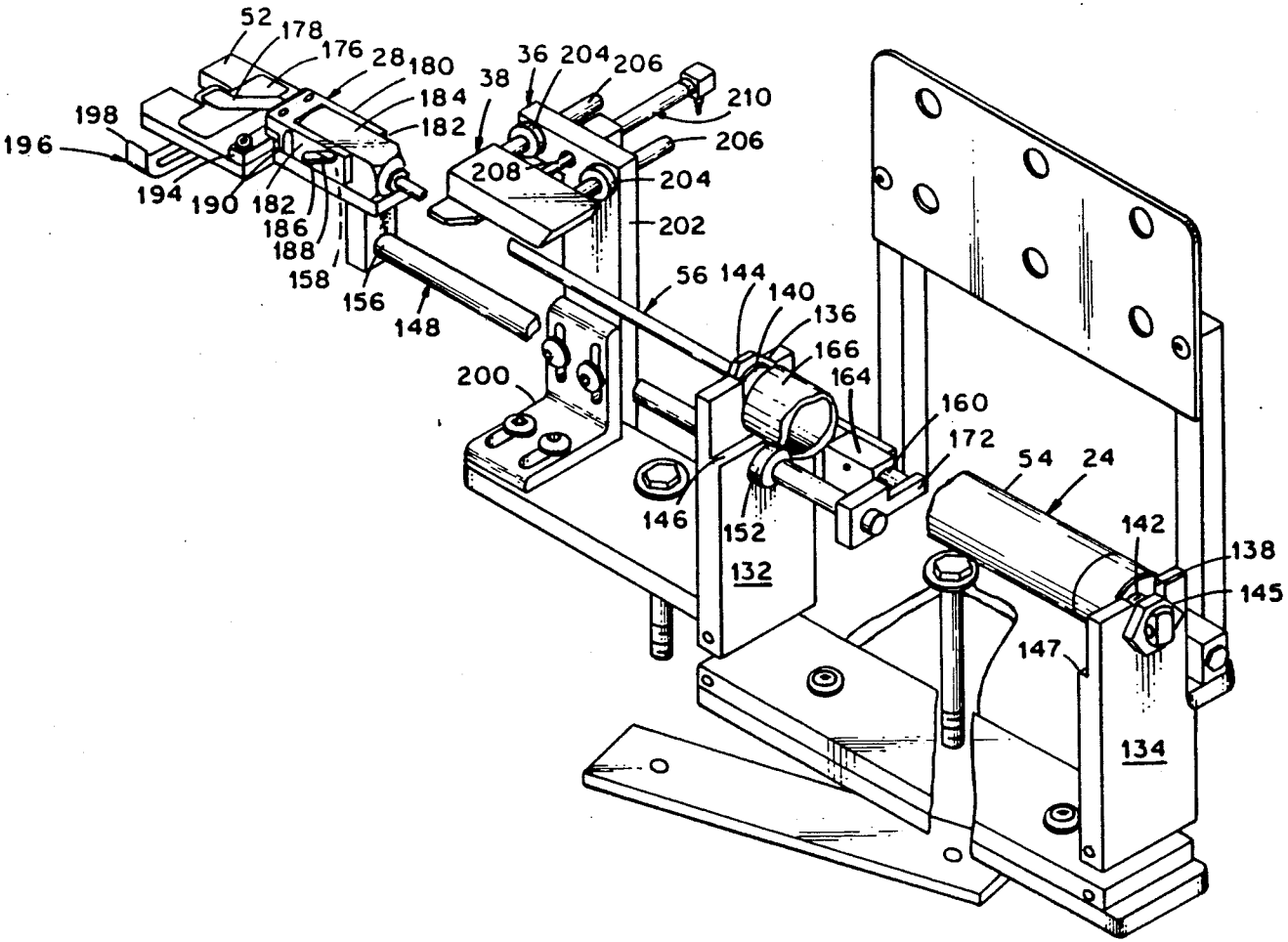
FIG. 4 is a perspective view of a card delivery assembly and card folding assembly of the apparatus of FIG. 1.

Referring now to FIGS. 1, 2 and 4, in conjunction with FIGS. 5*a* through 5*d*, there are shown various features of the delivery assembly 24 and folding assembly 36. The delivery assembly 24 is supported above the work table 12 on a pair of upstanding, spaced-apart yoke brackets 132 and 134. The brackets 132 and 134 include U-shaped grooves 136 and 138, respectively, extending downwardly from upper surfaces thereof for receiving within the grooves 136 and 138 forward and rearward mutilated bolt ends 140 and 142 of the cylinder 24 carrying nuts 144 and 145, respectively, for tightening the cylinder 24 between the brackets 132 and 134. The cylinder 24 rests on inwardly facing shoulders 146 and 147 of the brackets 132 and 134, respectively. A guide rod 148 is slidably received through a sleeve 152 located in the bracket 132 generally below the cylinder 24, the sleeve 152 having an axial length sufficient to maintain the guide rod 148 generally parallel to the axis of the rod 56. The guide rod 148 is connected at its forward end 156 to a lower surface 158 of the card holder 28 to prevent rotation of the card holder 28 about the axis of the rod 56 as the card holder 28 is advanced and retracted from and to the cylinder 24.

Movement of the card holder 28 is sensed by a limit valve 160 projecting from a valve housing 164 mounted adjacent a head 166 of the cylinder 24, and a limit valve 162 projecting from a valve housing 168 mounted at adjacent a back portion 170 of the cylinder 24. As can be seen in FIG. 1, the valves 160 and 162 face each other with the valve 160 being engageable by the front of a laterally projecting finger 172 (see FIG. 4) connected to the end of the guide rod 148, and being operable to stop advancement of the rod 56 and card holder 28. In the preferred embodiment, engagement of the valve 160 is further operable to cause the jaw 60 of the gripping head 42 to close and clamp the card therebetween, cause the card holder 28 to release the card, and cause the card holder 28 to be retracted. Retraction of the rod 56 supporting the card holder 28 is stopped by engagement of the back of the finger 172 against the valve 162 which causes the flow of compressed air to the cylinder 24 to be interrupted so that motion of the rod 56 into the cylinder 24 is ceased. The valve 162 is also operable to cause the folding block 38 to be retracted and to cause the card loading assembly 32 to load a card onto the feed plate 52 of the card holder 28.

The card holding assembly 28 includes the feed plate 52, above which is located a clamp plate 176 that is supported by a spring bar 178 connected to a clevis 180, which in turn is connected along its sides 182 to a pneumatic block 184. A pair of sloping slots 186 (only one of which is visible in FIG. 4) slidably receive laterally extending pins 188 of the pneumatic block 184. The pins 188 reciprocate interlockingly with an internal piston (not shown) of the pneumatic block 184 horizontally towards and away from the feed plate 52. Bias means (not shown), such as a spring, is provided to maintain the clevis 180 and clamp plate 176 in the orientation shown in FIG. 1 with the clamp plate 176 lifted above the surface of the feed plate 52. Introduction of compressed air into the pneumatic block 184 causes the pins 188 to move in the direction of the feed plate 52 with the pins 188 engaging the upper edges of the slots 186 causing the clevis 180 to pivot about a pair of trunnions 190. The slope of the slots 186 is selected so that when the pins 188 reach the limit of their forward travel, the clamp plate 176 is rotated down onto the upper surface of the feed plate 52 and resiliently held thereon by the spring bar 178.

Interrupting the supply of compressed air to the pneumatic cylinder 184 permits the biasing me and to rotate the clevis 180 about the trunnions 190 and lift the clamp plate 176 off of the feed plate 52, it being seen that during the pivoting of the clevis 180 movement of the edges of the slots 186 against the pins 188 causes the piston within the pneumatic block 184 to retract in a rearward direction preparatory to the next cycle.

A transverse edge bar 194 prevents rearward displacement of a card being held between the clamp plate 176 and the feed plate 52 as the card is advanced toward the sewing station 50 and is located on the feed plate 52 to be adjacent and generally parallel to the side edge of a card loaded onto the feed plate 52 from the card magazine 34. A finger 196 is adjustably mounted on the lower surface of the feed plate 52, and has an upturned portion 198 for being pre-positioned to be adjacent the front edge of the card loaded onto the feed plate 52. Preferably, the finger 196 is adjusted so that when the card is loaded onto the feed plate 52, the front edge of the card is in contact with the upturned portion 198. In this manner, the finger 196 and transverse bar 194 combine to restrain any significant movement of the card being clamped between the feed plate 52 and the clamp plate 176 as the card is advanced towards the sewing station 50, and particularly when the card is moved against the folding block 38.

The folding assembly 36 includes an angle bracket 200 supporting a vertical brace 202 having an inverted L-shaped configuration as shown in FIG. 4. The upper portion of the brace 202 is configured to receive a pair of spaced-apart sleeves 204, each of which slidably receives therethrough one of a pair of parallel guide rods 206 which support the folding block 38, and prevent rotation of the block 38 about the axis of a rod 208 connected to the back of the folding block 38. The rod is carried in a double acting cylinder 210 configured to cause the rod 208 to reciprocate by compressed air selectively admitted therein. The cylinder 210 is capable of moving the rod 208 into and out of the cylinder 210 to advance and retract the folding block 38 crosswise of the path of movement of the card holder 28 between a retracted position 212 (see FIG. 5*a*) and an advanced position 214 (see FIG. 5*c*).

Figure 5A:
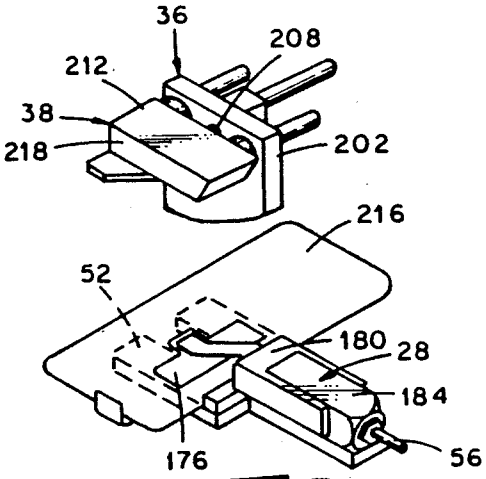
Figure 5B:
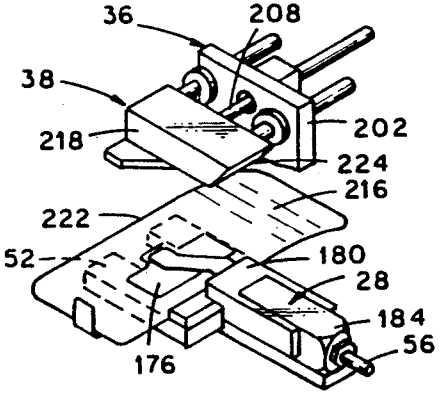
Figure 5D:
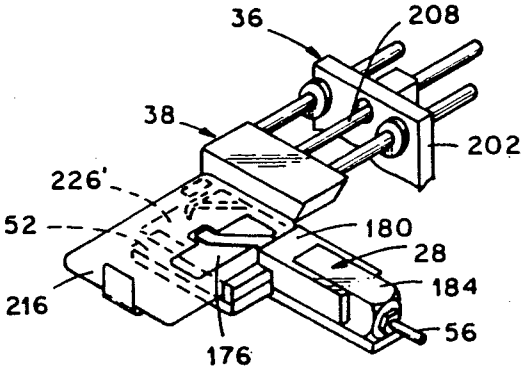
Figure 5C:
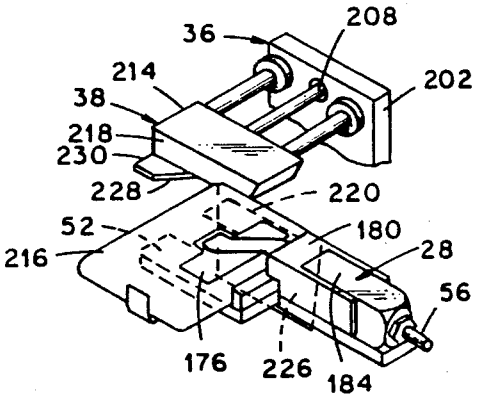

With particular reference to FIGS. 5*a* through 5*d*, a preferred means for folding a card 216 as it is delivered to the sewing station 50 is illustrated. In FIG. 5*a*, the card 216 is shown clamped between the feed plate 52 and the clamp plate 176 subsequent to loading of the card 216 on the feed plate 52 from the card magazine 34. In response to a signal generated by the sensor 48, air is admitted to the cylinder 24 to cause the rod 56 and card holder 28 to advance toward the sewing station 50. Simultaneously with advancement of the card holder 28, the folding block 38 is made to advance crosswise of the movement of the card holder 28 to the advanced position 214 as shown in FIG. 5*c* which locates a front face 218 of the block 38 just outside of the path of movement of a lateral edge 220 of the feed plate 52. Preferably, crosswise advancement of the folding block 38 is timed to precede the arrival of the card 216 at a location adjacent the block 38 with the first contact between a leading edge 222 of the card 216 and a sloping side surface 224 of the block 38 occurring with the block 38 approximately half way between the retracted position 212 and the advanced position 214. As the holder 28 is further advanced toward the sewing station 50, the block 38 and card holder 28 converge to the orientation of FIG. 5*c* to cause a lateral portion 226 of the card 216 to be folded downwardly around the lateral edge 220 of the feed plate 52. Continued advancement of the card holder 28 after the block has reached its advanced position 214 causes the downwardly folded lateral portion 226 of the card 216 to engage an angular surface 228 of a laterally projecting flange 230 extending from the bottom of the front of the folding block 38. This results in the further folding of the lateral portion 226 of the card 216 under the feed plate 52 with the lateral portion 226 being approximately parallel to the portion of the card 216 held between the feed plate 52 and clamp plate 176. It is noted that the flange 230 of the folding block 38 is located just beneath the path of movement of the feed plate 52 so that the feed plate 52 can ride over the upper surface of the flange 230 with a now fully folded portion 226' of the card 216 between the feed plate 52 and the flange 230 as shown in FIG. 5*d*.

Figure 5E:
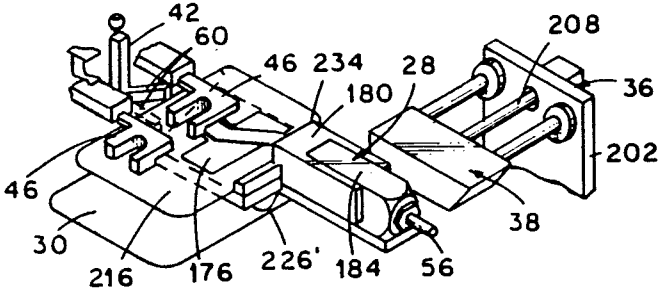

As shown in FIG. 1, a vertical back side 232 of the block 38 is substantially aligned with the right-hand edge 58 of the throat plate 30. This insures that continued movement of the card holder 28 past the block 38 towards the sewing station 50 will present the card to the sewing station 50 with the folded part 226' of the card 216 laying on the upper surface of the throat plate 30 as shown in FIG. 5*e*. Otherwise, it is likely that the resiliency of the card 216 would cause the folded portion 226' to flip downwardly and engage the edge 58 of the throat plate 30 and crush or bend the card 216 as it is moved to its position above the throat plate 30.

When the card holder 28 reaches a delivery position 234 over the throat plate 30, the griping head 42 of the gripping assembly 40 has been advanced to a position shown in FIG. 5*e* intermediate the presser feet 46 (partially shown in FIG. 5*e*) so that the leading edge 222 of the card 216 is between the jaws 60 of the gripping head 42. Then, as described, actuation of the grip-closing pneumatic cylinder 62 causes the jaws 60 to close and clamp the card therebetween while the card 216 is released by the card holder 28, which is then retracted to its position adjacent the card magazine 34.

Referring now to FIGS. 1 and 2 in conjunction with FIG. 6, the presser foot assembly 44 is shown mounted on a shift plate 240 which in turn may be shiftably mounted for movement between a left hand and a right hand position (not shown) to move the entire presser foot assembly 44 to the left or right as viewed in FIG. 1. A pair of upstanding brace members 242 and 243 are located at the left-hand end of the shift plate 240 and slidingly receive therethrough within sleeves 246 a pair of vertically aligned, horizontally extending guide rods 248 which support a forward ends 250 thereof a presser foot support 252, in addition to preventing vertical rotation of the support 252. A rod 254 is connected to the support 252 and carried within a double-acting pneumatic cylinder 256 extending generally through the brackets 242 with the rod 254 and cylinder 256 being generally parallel to the guide rods 248. An arm 260 fixedly connected to the support 252 holds the throat plate 30 below the presser feet 46 in a spaced relationship therewith. This results in the throat plate 30 and presser feet 46 being moved together at any time that the support 252 is made to move forwardly or rearwardly, and at any time the shift plate 240 may be moved to the right or the left.

Movement of the support 252 proceeds according to a preselected sewing pattern, such as indexing between two sewing positions, to locate a selected pair of vertically aligned openings 261 and 263, or 265 and 267, of the presser feet 46 and throat plate 30, respectively, under the needle 18. Movement of the presser feet 46 and throat plate 30 between positions with the openings 261 and 263 below the needle 18 is sensed by limit valves 300 and 302 (see FIG. 2) mounted in front and back housings 304 and 306, respectively, which in turn are attached to and extend from the left-hand sides of the brace members 242 and 243, respectively. As shown, the valves 300 and 302 face in opposite directions with the valve 302 being located to be engaged when the support 252 moves forwardly by an arm 308 fixedly connected to the upper guide rod 248. The valve 300 is located for being engaged when the support 252 moves rearwardly by the end of a rearwardly directed, adjustably mounted screw 310 attached to the 1®ft-hand side of the support housing 252. The limit valve 300 is operable, when engaged by the screw 310 to reset selected valves as described below with reference to FIG. 8, and to interrupt the supply of air to the cylinders 66 permitting the springs therein to raise the presser feet 46 away from the throat plate 30. The limit valve 302 is operable, when engaged by the arm 308, to cause the machine 14 to begin sewing with the needle 18 being above the pair of aligned openings 263 and 267 of the presser feet 46 and throat plate 267, respectively.

It is important to note the interaction between the gripping assembly 40 shown in FIG. 7 and the other parts of the apparatus 10 described above, and additionally the downward movement of the presser feet 46 to press the material segment and card against the upper surface of the throat plate 30. In this regard, it is seen that the gripping head 42 is supported on the end of a rod 262 carried within a single acting cylinder 264. The cylinder 264 is operable to cause the rod 262 to advance toward the sewing station 50 by selectively admitting compressed air into the cylinder 264 causing the rod 262 to move out of the cylinder 264. When extended, the rod 262 supports the gripping head 42 in a gripping position 266 shown in FIG. 7 whereat the cylinder 62 is operable to cause the jaws 60 to close. Provision is made to interrupt the supply of air to the cylinder 62 in response to initiation of a sewing operation at the sewing station 50 whereupon a spring 270 (see FIG. 1) causes the jaws 60 to open and release the card 216'. At the same time, the supply of compressed air to the cylinder 264 is interrupted. When this occurs, an elongate spring 272 connected between the gripping head 42 and a collar support 274 holding the cylinder 264 at its back-end causes the rod 262 to retract into the cylinder 264 moving the gripping head 42 away from the sewing station 50 as well as from between the presser feet 46, to a retracted position 276 as shown in FIG. 1. Thus, the gripping head 42 releases the card 216 and is retracted at substantially the same time as the presser feet 46 begin moving downwardly towards the throat plate 30 so that the gripping head 42 does not interfere with movement of the presser feet 46 and throat plate 30 through the predetermined sewing program. Also, as shown in FIG. 7, the gripping assembly 40 is mounted by a bracket 280 to an upstanding brace 282 fixedly connected to the guide rods 248 and the arm 260, and thus is movable through the sewing sequence along with the presser feet 46 and throat plate 30. Therefore, the gripping assembly 40 remains at a fixed height above the throat plate 30 when the presser feet 46 are moved downwardly. A pneumatic circuit 318 for controlling the operation of the apparatus 10 will now be described with reference to FIG. 8, continuous reference being had to the preceding FIGS. 1 through 7. The various elements that comprise the circuit 318 are interconnected according to the control logic employed in the system, the interconnections being shown in the drawing in the form of lines representative of pneumatic conduits used in the circuit 318. For the purpose of clarity, the lines will not be given individual reference characters. Instead, the nature of the functional interconnection of the elements will be described with reference being had to the drawings for the purpose of following the lines and nodal connections for specific interconnections.

In a preferred form of the circuit 318, substantially identical sequence valves 320, 322, 324, 326, 328, 330, 332, 334, 336, and 338 are employed to accomplish a series of sequential step functions, steps 1 through 10 ($S_1$ through $S_{10}$), to be described below. The sequential valves 320 through 338 are suitably provided by a model number R-932 sequential valve sold by Clippard Instrument Laboratory, Inc., 7390 Colerain Road, Cincinatti, Ohio which is one of a line of modular components sold under the trademark Clippard Minimatic. And, while omitted for clarity, a supply S is provided at each sequence valve for being passed to an outlet of the valve in response to its actuation. When applicable, the other valves to be described as elements of the circuit 318 will be designated by reference characters as well as by their Clippard Minimatic model number(s).

An on/off toggle switch 340 on the display panel 26 (see FIG. 1) is provided to make available a supply S of compressed air at selected elements of the circuit 318 as will be described. Another switch (not shown) is provided for energizing the belt drive 22, sensor 48, and other electrically powered components of the apparatus 10.

The description of the pneumatic system begins at the first step $S_1$ at sequence valve 320. As shown, the limit valve 162 of the card delivery assembly 24 is connected between the supply S and the sequence valve 320. Unless otherwise stated, the limit valves are configured to be normally closed. Limit valve 162 is opened by retraction of the rod 56 in the cylinder 54 to admit the supply S into the sequence valve 320. An outlet of sequence valve 320 is connected to a pilot input of a pilot valve 344, a model number R-432 twin pilot four way valve, powering the cylinder 88 of the loading assembly 32. The output of sequence valve 320 is also connected to a pilot input of a pilot valve 346, a model number R-402 four way valve, powering the cylinder 210 of the folding assembly 36.

Admitting air into sequence valve 320 pilots valve 344 causing the rod 86 to advance out of the cylinder 88 whereupon limit valve 115 is engaged (the limit valves are also shown symbolically as triangles adjacent their respective pneumatic cylinders in FIG. 8). Valve 346 is piloted to admit supply S into cylinder 210 causing retracting of rod 208, and thus the folding block 38. Limit valve 162 is also connected to a limit valve 374 to make the supply S available for being admitted into the parts of the circuit 10 using a foot pedal 376 a will be described more fully below. Flow control valves 348 and 350 may be used in the lines connecting the valve 344 with the cylinder 88 to control the rate of movement of the rod 86 in the cylinder 88.

Activating limit valve 115 causes the supply S to be admitted into sequence valve 322 initiating the next step $S_2$. Air from sequence valve 322 is delivered to a pilot input of a pilot valve 352, a model-432 double piloted valve, which has an outlet port connected to a pilot input of valve 344 and to the pneumatic block 184 of the card holder 28 through a Model MEV-2 poppet-type quick exhaust valve 353. This pilots valve 344 delivery supply S to the cylinder 88, and retracting the rod 86 causes the card holder 28 to clamp a card on the feed plate 52 as described.

The retraction of the cylinder 86 opens limit valve 116 which is connected to a pilot input of a pilot valve 354, a model number R-323 three way combination valve, piloting valve 354 to a position operable to pass air into sequence valve 324. As will be described, air is passed through valve 354 when a manual delivery button 380 is pushed, or when the sensor 48 detects the absence of a card at the sewing station 50. Assuming either of these conditions exist, sequence valve 324 delivers air to a pilot input of valve 346 piloting the latter to a position causing advancement of the rod 208 out of the cylinder 210 of the folding assembly 36. The sequence valve 324 is also connected to a pilot input of a pilot valve 356, a model R-432 twin pilot 4-way valve, piloting the valve 356 to a position causing advancement of the rod 56 out of the cylinder 54 of the delivery assembly 28. Additionally, sequence valve 324 is connected to a pilot input of a pilot valve 358, a model R-402 4-way valve, piloting the valve 358 to a position causing air to pass through a Model MEV-2 poppet-type quick exhaust vlave 359 which causes advancement of the gripping head 42 towards the sewing station 50, and is connected to a shuttle valve 360 having an output connected to a pilot input of a pilot valve 362, a model R-322 three way combination valve, piloting the valve 362 to a position interrupting the supply of compressed air to the grip-closing pneumatic cylinder 62 of the gripping head 42 permitting the spring 364 of the gripping head 42 to cause retraction of the rod within the cylinder 62, opening the jaws 60.

Advancement of the rod 56 out of the cylinder 54 of the delivery assembly 24 activates limit valve 160 which connects the supply S to sequence valve 326 initiating the next step $S_4$. The output of sequence valve 326 is connected to a shuttle valve 370 that is connected to a pilot input of sequence valve 320. Since the sequence valves employ differential pilots, supplying compressed air to the designated pilot input of sequence valve 320 opposite the pilot input of sequence valve 320 connected to limit valve 162 prevents the actuation of sequence valve 320 when limit valve 162 is actuated. Thus, the first four steps $S_1$–$S_3$ cannot be repeated when air from sequence valve 326 to sequence valve 320 is interrupted.

The output of sequence valve 326 is also connected to a pilot input of valve 352, piloting the latter to a position removing the supply S from the card holder 28 causing the card holder 28 to release the card, and connecting the supply S of valve 352 to a pilot input of valve 356, piloting the latter to a position admitting the supply S to the cylinder 54 causing retraction of the rod 56. The output of sequence valve 326 is further connected to a pilot input of valve 362 piloting the latter to a position connecting the supply S to the pneumatic cylinder 62 of the gripping head 42 which closes the jaws 60, clamping the card therebetween. Retraction of the rod 56 in the cylinder 54 opens limit valve 162 and closes limit valve 160 which releases sequence valve 320 of step $S_1$. This admits the supply S into a line connected to limit valve 374 that is actuable by a foot pedal 376. Also, it is seen that steps $S_1$ and $S_2$ are repeated. $S_3$, however, will not repeat since there is a card at the sewing station 50 and the sensor 48 closes the line supplying air to valve 354. At this time, the apparatus 10 is in a hold position with a card having been delivered to the sewing station 50 and being held there above the throat plate 30 in the jaws 60 of the gripping head 42.

Pressing the foot pedal 376 to open limit valve 374 passes the supply S into sequence valve 328 initiating the next step S5. There are two outputs of sequence valve 328, one of which is connected to the sensor 48 and manual delivery button 380, the outputs of the sensor 48 and button 380 being connected to opposite inlet ports of a shuttle valve 382 which has an outlet port connected to a supply port of valve 354. In the absence of supply S from limit valve 374, sequence valve 328 will maintain air pressure at the sensor 48 and button 380 locations. But when the pedal 376 is depressed, neither the sensor 48 and the button 380 are inoperable.

The other output of sequence valve 328 is connected to a pilot input of valve 358 and the shuttle valve 360 which is connected to a pilot input of valve 362 and to a pilot input of valve 358. Thus, depressing foot pedal 376 removes the supply S from the cylinder 264 of the gripping assembly 40, retracting the gripping head 42, and connects the supply S of valve 358 with a pilot input of sequence valve 330 initiating the next step $S_6$. At the same time, air is passed into shuttle valve 360 piloting valve 362 to a position removing the supply S from the grip-closing cylinder 62 of the gripping head 42 permitting the springs 364 to open the jaws 60 releasing the card.

Piloting sequence valve 330 passes the supply S to a pilot input of a pilot valve 384, a model number R-322 three way combination valve, piloting the latter to a position passing the supply S through a pressure regulator 386 and into the cylinders 66, causing the rods 68 to move downwardly out of the cylinders 66 pressing the card and material segment between the presser feet 46 and the throat plate 30. Air is also passed from sequence valve 330 to a shuttle valve 388 connected to an inlet port of a normally open, self-piloting valve 390, a model number R-711 pulse valve, creating a pulse at a start cylinder 392 extending a rod 394 carried in the pulse cylinder 392 to close a normally open limit valve 396 and move a lever (not shown) attached to the sewing machine 14 causing sewing of a first tack with the needle 18 reciprocating in opening 261 of presser foot 46. Closing of limit valve 396 interrupts the supply S into a normally open, self piloted valve 398, a model number R-711 pulse valve, permitting the valve 398 to open. When the first tack is completed, cylinder 394 retracts opening limit valve 396 delivering a pulse of air to sequence valves 332 and 336. However, due to the interlocking of the sequence valves (not shown), the sequence valve 336 will not shift until sequence valve 334 has been shifted by limit valve 302. Thus, the pulse from pulse valve 398 shifts sequence valve 332 only, initiating the next step $S_7$. The output of sequence valve 332 is connected through a single/double tack toggle switch 401 to a pilot input of a pilot valve 400, a model number R-432 twin pilot four way valve. This pilots valve 400 to a position delivering the supply S through a flow control valve 402 causing the rod 254 to be extended out of the cylinder 256 of the presser foot assembly 44, shifting the presser feet 46 and throat plate 30 to a second tacking position under the needle 18 and also opens limit valve 302. This shifts sequence valve 334 initiating the next step $S_8$, passing air through shuttle valve 388 to a pilot input of pulse valve 390 which again causes the machine 14 to sew, completing a second tack with the needle 18 reciprocating in opening 263 of the back presser foot 46.

Completing the second tack opens limit valve 396 pulsing sequence valve 336 initiating the next step $S_9$ which pilots valve 400 to a position passing the supply S through a flow control valve 404 into the cylinder 256. This retracts rod 25, moving the presser feet 46 and throat plate 30 back in the direction of the sewing machine 14 with the opening 261 of the front presser foot 46 under the needle 18. Limit valve 300 is opened passing the supply S to the sequence valve 338, initiating the last step $S_{10}$.

The output of sequence valve 338 is connected through a shuttle valve 414 to valve 384, interrupting the supply S to the cylinders 66 whereupon the rods 68 are retracted in the cylinder 66 to lift the presser feet 46 off of the throat plate 30. Through a reset circuit (not shown), the output of sequence valve 338 is also operable to reset sequence valves 328 through 338 preparatory to the next sewing operation.

Removal of the card and material segment from the sewing station 50 activates the sensor 48 to open admitting the supplies into valve 354 to shift sequence valve 324, initiating the third step S3 delivering a card to the sewing station 50 whereupon the entire sequence is repeated. The manual/auto toggle switch 410 is in a line connecting normally open limit switch 396 with a pilot input of valve 354 and, when switched to manual, prevents piloting of valve 354 by limit switch 116 so that the delivery of a card can be accomplished only by using the delivery button 380. The single/full toggle switch 401 is connected to the output of sequence valve 332. The operation of the pneumatic system described above was considered with the toggle switch 412 in the full mode passing air to a pilot input of valve 400. In the single mode, the output of sequence valve 332 is passed to the shuttle valve 414 after the sewing of the first tack to produce the same result as the output of sequence valve 338.

The above features and advantages of the card feeding apparatus 10 provide for a substantially constant availability of cards at a predetermined position above the throat plate 30. The interactive sequence of loading, delivery, folding and gripping described offers an apparatus which permits very rapid attachment of cards to material segments. For example, the gripping assembly 40 holds a card above the throat plate 30 while the card holder 28 of the delivery assembly 24 is retracted to receive another card from the loading assembly 32. After the card is utilized, its removal is detected by the sensor 48 whereupon the next card is automatically delivered to the position above the throat plate 30 And the folding assembly 36 interacts with the delivery assembly 24 to fold a card into a desired shape, one of which has been illustrated, as the card is delivered. The apparatus 10 incorporates all of these functions, among others, into a single system which requires only minimal operator initiated steps, that is, the operator need only place the material segment at the sewing station 50 and initiate the sewing program. Thus, the operator need only remove the material segment and card, and the apparatus 10 automatically sets up for another attachment sequence.

Although a particular embodiment of the card feeding apparatus and method has been described in the foregoing detailed description, it will be understood that the invention is capable of numerous rearrangements, modifications and substitutions of parts without departing from the scope of the invention according to what is claimed below.

What is claimed:

1. A card feeding, folding and attaching apparatus comprising:

a supply of cards;

a work surface at which a card from the supply of cards is attached to a textile item;

means for delivering a card from the supply of cards to the work surface for attachment to the textile item;

means for folding the card as the card is delivered from the supply of cards to the work surface so that the card is substantially in a folded configuration at the work surface for attachment in the folded configuration to the textile item;

means for holding at least a portion of the folded card substantially stationary in spaced relation above the work surface and above the remaining portion of the card so that the textile item may be inserted between the held portions and the remaining portion for attachment of the folded card to the textile item; and means for attaching the folded card to the textile item at the work surface.

2. The apparatus of claim 1 wherein said folding means further comprises means for folding the card as it is delivered from the card supply to the work surface by said delivery means.

3. The apparatus of claim 1, wherein the apparatus is further configured so that as said holding means holds said portion of the card in spaced relation to the work surface, a remaining portion of the card is disposed generally between said holding means and said work surface.

4. The apparatus of claim 1, wherein said holding means is configured to hold the card at the work station independently of said delivery means.

5. The apparatus of claim 4, wherein said folding means is configured to interact with said delivery means to fold the card as it is being delivered to the work surface by said delivery means.

6. The apparatus of claim 1, wherein said folding means further comprises a folding block and is configured together with said delivery means so that said folding block makes contact with the card as it is delivered to the work surface by said delivery means to dispose the card substantially in the folded configuration substantially in advance of delivery of the card to the work surface by said delivery means.

7. The apparatus of claim 6, wherein said folding means is further configured to advance said folding block from a retracted position outside the path of movement of the card during its delivery to the work surface to a folding position in the path of movement of the card during its delivery to the work surface at which said folding block contacts the card, and to retract said folding block from said folding position to said retracted position following contact between said block and the card.

8. A card feeding, folding and attaching apparatus, comprising:

a supply of cards;

a work surface at which a card from the supply of cards is attached to a textile item;

delivery means for delivering a card along a path of movement from the supply of cards to the work surface;

folding means for folding the card as the card is delivered from the supply of cards to the work surface, said folding means including a folding block and being configured to move said folding block between advanced and retracted positions at which said folding block is positioned into and out of the path of movement of the card, respectively, as the card is delivered along said path of movement, and said folding block configured to contact the card in said advanced position as the card is delivered along the path of movement so as to dispose the card substantially in a folded configuration at the work surface;

means for holding at least a portion of the folded card substantially stationary in spaced relation above the work surface and above the remaining portion of the card so that the textile item may be inserted between the held portions and the remaining portion for attachments of the folded card to the textile item following delivery of the card to the work surface by said delivery means; and means for attaching the folded card to the textile item at the work station.

9. An apparatus for feeding and folding cards from a card supply to a work surface at which the cards are attached in a folded configuration to a textile item, comprising:

means for delivering a card from the card supply to the work surface;

means for folding the card so that the card is substantially in the folded configuration at the work surface for attachment in the folded configuration to the textile item, said means for folding comprising a folding block and being configured together with said means for delivering so that said folding block makes contact with the card as it is delivered to the work surface by said delivery means to dispose the card substantially in the folded configuration substantially in advance of delivery of the card to the work surface by said delivery means, said means for folding further comprising means for advancing said folding block from a retracted position outside of the path of movement of the card during its delivery to the work surface to a folding position in the path of movement of the card during its delivery to the work surface at which said folding block contacts the card, and to retract said folding block from said folding position to said retracted position following contact between said block and the card;

said means for delivering comprising holding means configured to hold a first portion of the card as the card is delivered to the work surface with a second portion of the card disposed to contact said folding block during delivery of the card, said folding block including first edge means for making initial contact with the second portion of the card to cause the card to be folded along a first fold line extending generally between said first and second portions of the card, and said folding block further including second edge means for making contact with the second portion of the card subsequent to folding of the card along said first fold line, said second edge means being configured to cause the second portion of the card to be folded along a second fold line spaced from said first fold line to dispose a first segment of the second portion of the card generally parallel to the first portion of the card with a second segment of the second portion extending generally between said first and second fold lines;

means for holding at least a portion of the folded card substantially stationary in spaced relation above the work surface for attachment to the textile items; and means for attaching the folded card to the textile item at the work station.

10. An apparatus for feeding and folding cards from a card supply to a work surface at which the cards are attached in a folded configuration to a textile item, comprising:

means for delivering a card from the card supply to the work surface;

means for folding the card so that the card is substantially in the folded configuration at the work surface for attachment in the folded configuration to the textile item, said means for folding comprising a folding block and being configured together with said means for delivering so that said folding block makes contact with the card as it is delivered to the work surface by said delivery means to dispose the card substantially in the folded configuration substantially in advance of delivery of the card to the work surface by said delivery means, said means for folding further comprising means for advancing said folding block from a retracted position outside of the path of movement of the card during its delivery to the work surface to a folding position in the path of movement of the card during its delivery to the work surface at which said folding block contacts the card, and to retract said folding block from said folding position to said retracted position following contact between said block and the card;

said folding block comprising first contact means for making initial contact with the card and configured to fold the card upon making contact therewith along a first fold line, and second contact means for contacting the card subsequent to said first contact means and configured to fold the card upon making contact therewith along a second fold line which is spaced on the card traversely of said first foldline relative to the direction of movement of the card as it is delivered to the work surface;

means for holding at least a portion of the folded card substantially stationary in spaced relation above the work surface for attachment to the textile item; and means for attaching the folded card to the textile item at the work station.

11. An apparatus for feeding and folding cards from a card supply to a work surface at which the cards are utilized in a folded configuration, comprising:

a delivery mechanism configured to deliver a card from the card supply to the work surface along a card movement path;

a folding block disposed in said card movement path so that the card contacts said block as it is delivered to the work station by said delivery mechanism;

a first edge formed on said folding block and disposed to make initial contact with the card, said first edge being substantially obliquely disposed in relation to the card movement path adjacent the location along said path at which said first edge contacts the card and positioned to cause the card to be deflected and folded along a first fold line extending generally parallel to said card movement path as the card moves past said first edge during its delivery to the work surface so that a first folded portion of the card is disposed generally parallel to said first edge; and a second edge formed on said block and being oriented generally perpendicularly to said first edge, said second edge being disposed substantially obliquely in relation to the card movement path and being positioned on said folding block so that said folded portion of the card contacts said second edge following contact between the card and said first edge, and so that the card is folded along a second fold line which is spaced from, and generally parallel to, said first fold line.

* * * * *